US006079676A

United States Patent [19]

Hackett et al.

[11] Patent Number: 6,079,676

[45] Date of Patent: Jun. 27, 2000

[54] ADJUSTABLE MOUSE PAD SUPPORT

[75] Inventors: Christopher J. Hackett, Walker; Timothy H. Haselhuhn, Hudsonville, both of Mich.

[73] Assignee: West Shore Services, Inc., Allendale, Mich.

[21] Appl. No.: 08/967,955

[22] Filed: Nov. 12, 1997

Related U.S. Application Data

[60] Provisional application No. 60/033,285, Dec. 9, 1996.

[51] Int. Cl.[7] ..... B68G 5/00

[52] U.S. Cl. ..... 248/118; 248/118.1; 248/918; 312/208.1

[58] Field of Search ..... 248/118, 918, 248/118.1, 118.3, 118.5, 441.1, 279.1, 52, 51, 346.01; 400/715, 682; 108/50.01, 50.02, 143; 312/208.1, 223.3

[56] References Cited

U.S. PATENT DOCUMENTS

| | | | |
|---|---|---|---|
| D. 367,387 | 2/1996 | Sweere | D6/511 |
| 5,031,867 | 7/1991 | Cotterill | 248/281.1 |
| 5,119,742 | 6/1992 | Simmie | 108/152 |
| 5,211,367 | 5/1993 | Musculus | 248/279 |
| 5,257,767 | 11/1993 | McConnell | 248/284 |
| 5,342,006 | 8/1994 | Tice | 248/118 |
| 5,351,897 | 10/1994 | Martin | 244/118 |
| 5,357,873 | 10/1994 | Hilton | 108/50 |
| 5,377,951 | 1/1995 | Johnson et al. | 248/639 |
| 5,429,337 | 7/1995 | Poole | 248/442.2 |
| 5,443,237 | 8/1995 | Stadtmauer | 248/441.1 |
| 5,490,710 | 2/1996 | Dearing et al. | 297/162 |
| 5,509,628 | 4/1996 | Noble | 248/118 |
| 5,522,572 | 6/1996 | Copeland et al. | 248/118 |
| 5,533,697 | 7/1996 | Fletcher et al. | 248/146 |
| 5,564,667 | 10/1996 | Copeland et al. | 248/278.1 |
| 5,636,822 | 6/1997 | Hendershot et al. | 248/346.01 |
| 5,655,743 | 8/1997 | Gillis | 248/346.01 |
| 5,704,698 | 1/1998 | Lin | 312/208.1 |

OTHER PUBLICATIONS

Fris Office Products, Holland, Michigan, 1996, pp. 65, 381, 383, 384.

Baer Supply Company, 1996, pp. 9 and 10.

*Primary Examiner*—Leslie A. Braun
*Assistant Examiner*—Kimberly Wood
*Attorney, Agent, or Firm*—Rader, Fishman, Grauer & McGarry an Office of, Fishman & Grauer PLLC

[57] ABSTRACT

An adjustable support assembly for a digitizer device, such as a track ball or mouse, mounts between a computer keyboard support tray and an articulating arm normally attached to the tray for supporting and adjusting the tray. The support assembly includes a right-hand support pad and a left-hand support pad that are slidable underneath the keyboard support tray in a stored position. One of the pads can be selectively exposed for use, while the other pad is stored underneath the keyboard support tray. The upper surface of the support pads are textured to enhance the tracking movement of a mouse ball. The exposed mouse pad is rotatably adjustable about an axis parallel to a longitudinal axis of the keyboard support tray to provide a horizontal surface for the mouse to ride on, even if the keyboard support tray is tilted away from horizontal. The support pads additionally include a slot extending inwardly from an outer edge thereof. The slot has opposing inner faces and a cord of resilient material with a high coefficient of friction material projecting from the faces toward each other to create a gap. The gap resiliently and frictionally holds a data cord associated with the digitizer device. The yieldable nature of the resilient material prevents damage to the data cord while securely retaining the data cord in the slot.

30 Claims, 4 Drawing Sheets

ADJUSTABLE MOUSE PAD SUPPORT

CROSS REFERENCE TO RELATED APPLICATION

This application claims the benefit of U.S. Provisional Application No. 60/033,285 filed on Dec. 9, 1996.

BACKGROUND OF THE INVENTION

1. Field of the Invention

This invention relates to support structures for computer accessories, and more particularly to an adjustable mouse pad for attachment to a keyboard support.

2. Description of the Related Art

In recent years, as computers have accelerated in popularity, many devices have been proposed to facilitate their usage. A keyboard support is one such device that has become widely accepted with computer users. The keyboard support is typically mounted below a desktop, tabletop, or other horizontal work surface at a position beneath a computer monitor and/or a CPU supported thereon. The keyboard support is usually slidable to an under-surface storage position when not in use and includes vertical and tilting adjustments to accommodate different comfort zones for different users. The keyboard is typically adjusted below and away from the standard desktop during use by most computer users.

With the advent of Windows™, OS/2™ and other similar computer operating environments, the use of a digitizer mouse has become more prevalent. A friction pad is typically placed on the desktop adjacent to the computer monitor and/or CPU. A digitizer mouse is then positioned on the friction pad and rolled to various locations thereon. The mouse movement is proportional to cursor movement on the computer screen and provides access to various functions in a computer program. In most software applications, it is often necessary to shift between mouse functions and the keyboard for typing. Since the keyboard is typically mounted on a keyboard support tray located below the desktop, and the mouse is supported on the desktop, the task of reaching for the mouse and then repositioning one's hand at the proper keyboard location to recommence typing is inconvenient and time-consuming. Repetitive movement between the different heights occupied by the keyboard and mouse can also cause muscle strain on the back and/or shoulder areas of a user, which may result in discomfort or pain in these areas. Discomfort and pain in these areas is especially prominent in users with previous back and shoulder injuries.

In an attempt to address this problem, many different types of mouse support trays in cooperation with keyboard supports have been proposed which can be divided into two categories. Mouse support trays of a first category include a mounting bracket that is attachable to the underside of a desktop or other surface. One type of mouse support in this category is similar in construction to the above-described keyboard support that is slidable, tiltable, and vertically adjustable. This type of mouse support is constructed of a number of parts and is relatively expensive and cumbersome. The mouse support surface itself has a relatively large surface area and takes up more space than the digitizer mouse requires for corresponding cursor movement across a computer screen. With the downsizing of work cubicles and their associated work surfaces, the large surface area of the mouse pad becomes impractical. In addition, mouse supports of this category are installed on one of the right or left hand sides of the keyboard, depending on the personal preference of a computer user. This type of support is inappropriate for mounting to a computer system that would be used by both right and left-handed users.

Mouse support trays of a second category are directly mounted to the keyboard support tray and are generally mountable to one of the left or right sides of the keyboard support tray, again for left-handed or right-handed users. The mouse support tray is positioned under the keyboard support when not in use. Although this type of mouse support tray is less costly than trays of the first category, the mouse and keyboard support trays from the same manufacturer are typically designed to interface with each other, to the exclusion of support trays made by other manufacturers. Thus, if it is desired to install a mouse support tray to a pre-installed keyboard support, the mouse support tray must be ordered from the manufacturer or distributor for that particular keyboard support, whether or not the particular design is what the customer desires. Moreover, since the mouse tray is attached to the keyboard tray, the mouse tray parallels the tilt adjustment of the keyboard tray which is typically tilted to accommodate the user. Consequently, the mouse has a tendency to slide off the mouse tray and may be damaged. As with the first category, the mouse support surface itself has a relatively large surface area and takes up more space than the digitizer mouse requires for corresponding cursor movement across a computer screen.

SUMMARY OF THE INVENTION

These and other problems of the prior art are overcome by the provision of an adjustable mouse support assembly that mounts to the underside of a keyboard support tray.

According to one aspect of the invention, the mouse support assembly is mounted between the keyboard support tray and an articulating arm normally attached to the tray for supporting and adjusting the keyboard support tray.

According to a further aspect of the invention, the mouse support assembly includes a right hand mouse support pad and a left hand mouse support pad that are slidable underneath the keyboard support tray in a stored position. One of the mouse pads can be selectively exposed for use, while the other mouse pad is stored underneath the keyboard support tray. The upper surface of the mouse support pads are preferably textured to enhance the tracking movement of the mouse ball.

According to another aspect of the invention, the exposed mouse pad is rotatably adjustable about an axis parallel to a longitudinal axis of the keyboard support tray to provide a horizontal surface for the mouse to ride on, even if the keyboard support tray is tilted.

The invention in one of its aspects comprises an adjustable support assembly for attachment to a computer keyboard support tray includes a pair of spaced-apart rails for mounting to the keyboard support tray; an insert mounted for slidable movement on the rails; and a support pad connected to the insert for slidable movement therewith between a retracted storage position wherein the support pad is in contact with the rails and an extended in-use position wherein the support pad is free of the rails. Preferably, the support pad is pivotally attached to the insert for rotational movement about a pivot axis substantially parallel to the direction of slidable movement. The insert includes a lower surface in sliding contact with the rails, opposite end surfaces projecting upwardly from the lower surface and an aperture extending between the opposite end surfaces. The support pad includes an upper surface, opposite end surfaces projecting downwardly from the upper surface, and an aperture extending between the opposite end surfaces. A pivot rod extends through each aperture for pivotally connecting the insert to the support pad. A fastener is connected to the pivot rod for selectively clamping the insert and support pad together to thereby prevent relative rotation between the insert and support pad.

In another of its aspects, a second support pad is pivotally connected to the insert such that the insert is between the support pads. The second support pad also includes an aperture extending between opposite ends thereof for receiving the pivot rod. Preferably, the ends of the pivot rod extend outwardly from the outer end surfaces of the support pads, and an adjustable fastener is attached to each end of the pivot rod for clamping the insert and support pads together to thereby prevent relative rotation between the insert and support pads.

According to an even further aspect of the invention, the lower surface of the insert has a groove extending between the end surfaces of the insert, and each of the support pads has a groove in their respective lower surfaces beginning at the end surface proximal to the insert and terminating before the other end surface. A stud is attached to the mounting plate and projects into one of the grooves, such that sliding movement of the insert and support pads is stopped when the stud contacts one of the groove terminations.

Preferably, the insert, support pads and fasteners are sized to be received completely under the keyboard support tray when the support pads are in the retracted storage position.

Further according to the invention, a support pad for supporting a digitizing device includes a panel having an upper surface for supporting the digitizing device, a lower surface spaced from the upper surface, and an outer edge extending between the upper and lower surfaces. A slot extends through the outer edge and into the upper and lower surfaces of the panel, the slot has opposing inner faces that frictionally receive and hold the data cord of the digitizing device therebetween. Preferably, a piece of resilient friction material is attached to each inner face. The pieces of friction material project from the faces toward each other for yieldable, frictional engagement with data cords of different cross dimensions.

These and other objects, features and advantages will be apparent from the ensuing description taken in conjunction with the accompanying drawings.

BRIEF DESCRIPTION OF THE DRAWINGS

The invention will now be described with reference to the drawings in which.

DETAILED DESCRIPTION OF THE PREFERRED EMBODIMENTS

Figure 1:
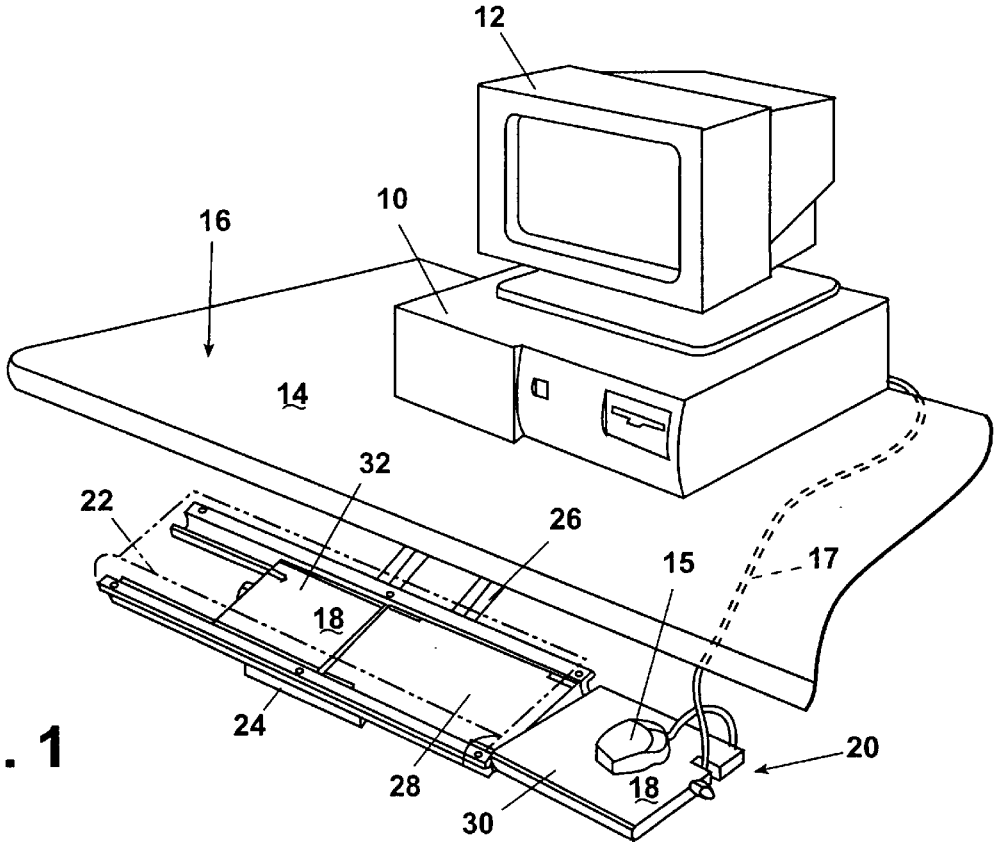
FIG. 1 is a perspective view of a computer system supported on a work surface and a keyboard training an adjustable mouse support assembly according to the invention posited in a right-handed configuration.
Figure 2:
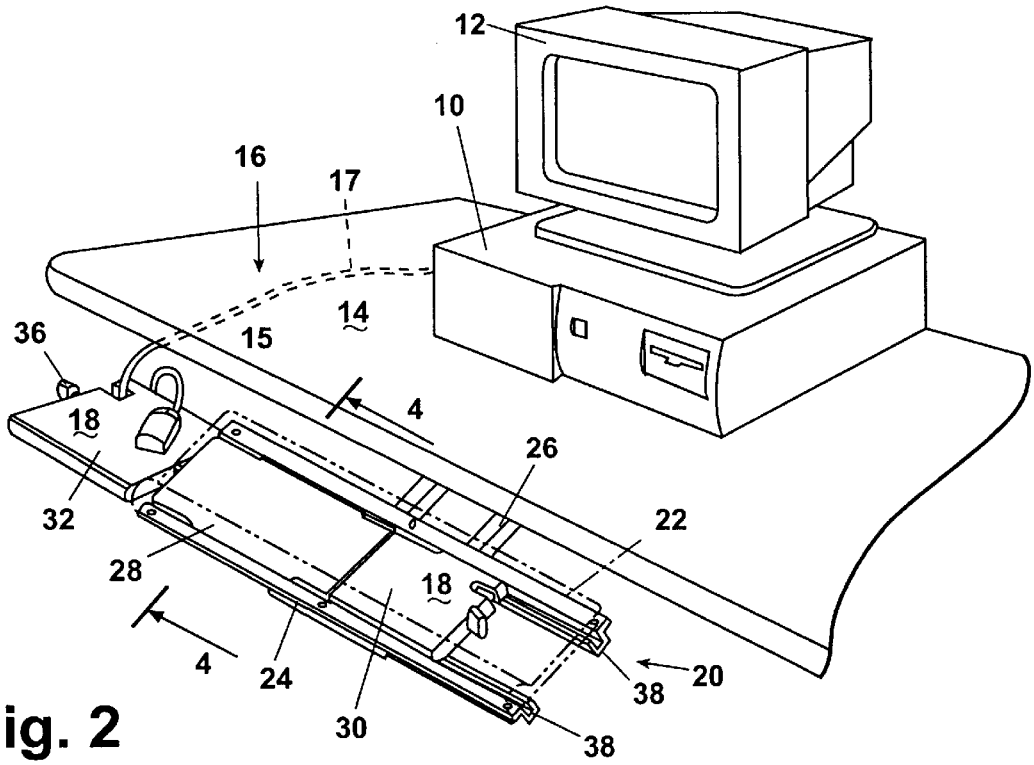
FIG. 2 is a perspective view similar to FIG. 1 showing the adjustable mouse support tray position in a left-hand configuration.
Figure 3:
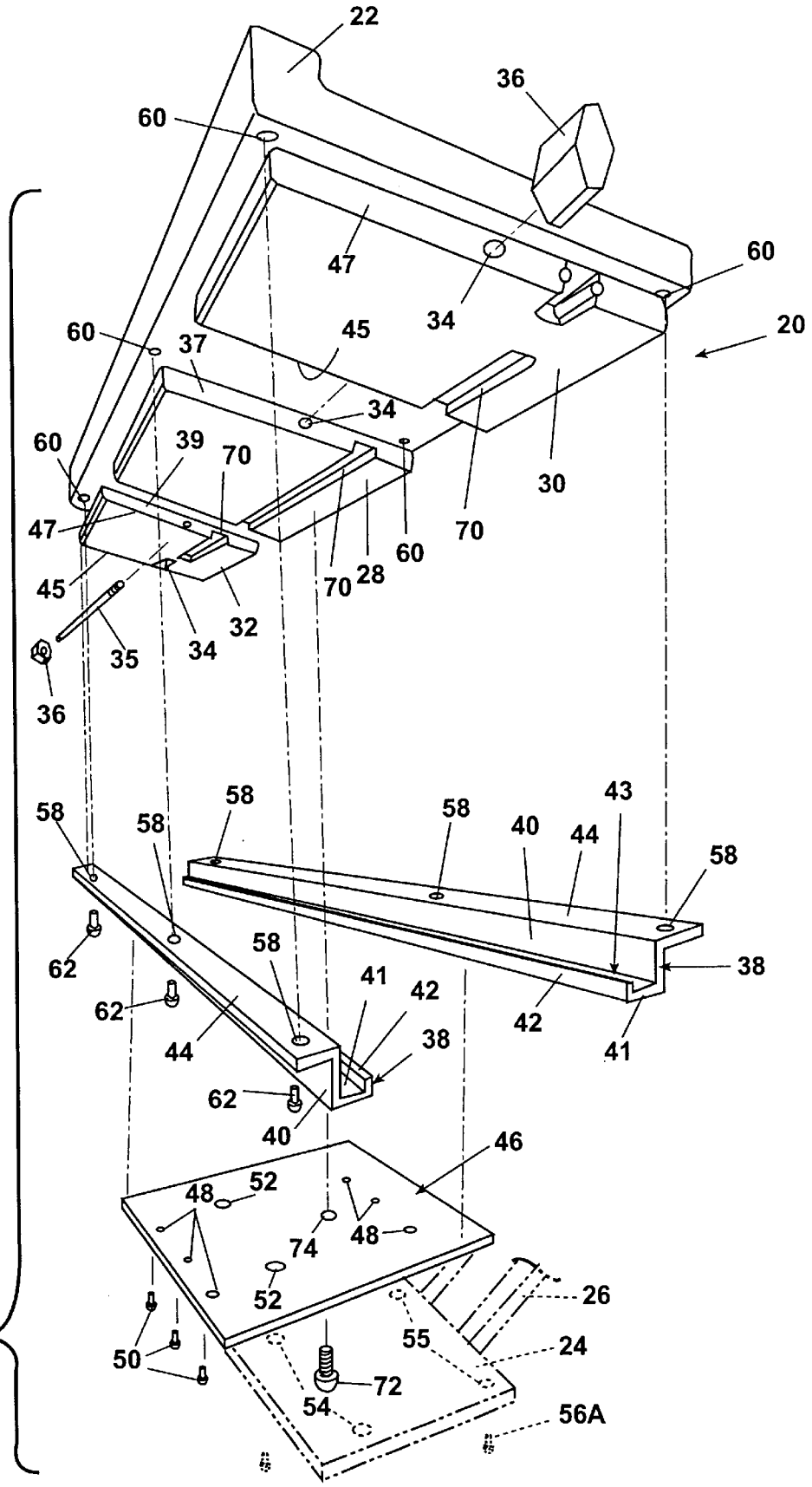
FIG. 3 is an exploded perspective view of the adjustable mouse support assembly and keyboard support of FIG. 1.

Referring now to the drawings and to FIGS. 1–3 in particular, a computer base 10 with a monitor 12 are placed on an upper surface 14 of a work surface 16. An adjustable mouse support assembly 20 is positioned intermediate a keyboard support tray 22 and a support tray mounting bracket 24. One end of an articulating arm 26 is attached to the mounting bracket 24 while the other end of the arm 26 is mounted to a lower surface of the work surface 16 for supporting and adjusting the keyboard support tray in a well-known manner.

The mouse support assembly 20 includes an insert or central section 28, a right-hand mouse support pad or tray 30, and a left-hand mouse support pad or tray 32. An upper surface 18 of the mouse support trays are preferably textured to enhance mouse ball tracking movement. As stated previously, with the down-sizing of work cubicles and their associated work surfaces, the large surface area of prior art mouse support trays becomes impractical. In a preferred embodiment, the mouse support trays 30, 32 are approximately seven inches long and five inches wide. This is a significant reduction in size over prior art mouse support trays that are typically eight inches long by eight inches wide. It is to be understood, of course, that the mouse support trays 30, 32 of the present invention can be constructed in other sizes to accommodate any space requirements. A conventional mouse 15 or other digitizing device and a portion of the mouse data cord 17 are supported on one of the mouse trays 30 or 32. The cord 17 is also preferably frictionally attached to one of the mouse trays, as will be described in greater detail below. An aperture 34 is located between the upper and lower surfaces and extends between the ends 37, 39 of the central section 28 and the ends 45, 47 of the right and left support trays 30 and 32. The mouse support trays are pivotal with respect to the central section about a pivot rod 35 that is telescopically received in the aperture 34 of the central section and each mouse tray. Once the central section and trays are installed on the pivot rod 35, a thumb nut 36 is threaded over each end of the pivot rod 35 to retain the central section 28, mouse trays 30, 32 and pivot rod 35 as an assembly.

The central section 28 and the trays 30 and 32 are slidably mounted on a pair of oppositely disposed rails 38. The rails 38 each include a guide wall 40 integrally formed with a slide flange 42, a bight flange 41 extending between the guide wall 40 and slide flange 42, and a mounting flange 44 depending from the guide wall 40. A mounting channel 43 is formed between the guide wall 40, slide flange 42 and bight flange 41. Each rail 38 is secured to a mounting plate 46 with fasteners 50, such as rivets, bolts, etc. The plate 46 includes two sets of multiple apertures 48 and the mounting channel 41 of each rail 38 includes corresponding apertures (not shown) for receipt of the fasteners 50. A pair of front apertures 52 extend through the mounting plate 46 and correspond with a pair of front apertures 54 that extend through mounting bracket 24. Each corresponding set of apertures 52, 54 receives a self-tapping fastener 56 for securing the mounting plate 46 to the mounting bracket 24. A self-drilling screw 56A is inserted into a pair of rear apertures 55 that extend through the mounting bracket 24. The self-drilling screw 56A forms a threaded aperture in the plate 46 upon rotation of the screw to secure the rear end of the plate 46 to the bracket 24. With this arrangement, the plate 46 can be mounted to brackets 24 of different sizes. Alternatively, the front apertures 52 of the plate 46 can be eliminated and self-drilling screws can be inserted into the front apertures of the bracket 24 to mount the front end of the plate to the bracket. Apertures 58 are provided in each mounting flange 44 and correspond with apertures 60 provided in the keyboard support tray 22. The apertures 60 may be preformed in a bottom of the support tray 22, or may be formed by drilling and/or the installation of self-tapping screws, such as fasteners 62. A screw-type fastener 62 is received in each set of corresponding apertures 58, 60 for fastening the rails 38 to the keyboard support tray 22.

If the support tray is not mounted to an articulating arm, then the mounting plate 46 may be eliminated and the rails 38 mounted directly to the support tray lower surface. Thus, the mouse support assembly according to the invention is adaptable to most any keyboard support tray, with or without an articulating arm.

The mouse support assembly 20 is dimensioned such that all three sections can be simultaneously stored under the keyboard support tray when the sections are moved along the side flange 42 to a central position. Alternatively, one mouse support tray can extend to the right or left of the keyboard support tray for supporting a computer mouse thereon, as shown in FIGS. 1 and 2 for right and left-handed operation of the mouse. The mouse support trays 30 and 32 are rotatable about the pivot rod 35 when in the extended position to provide a horizontal surface when the keyboard support tray is tilted with respect to horizontal. The mouse support trays 30 and 32 can also be adjusted to any desired angle and then fixed by tightening the exposed thumb nut 36.

Figure 4:
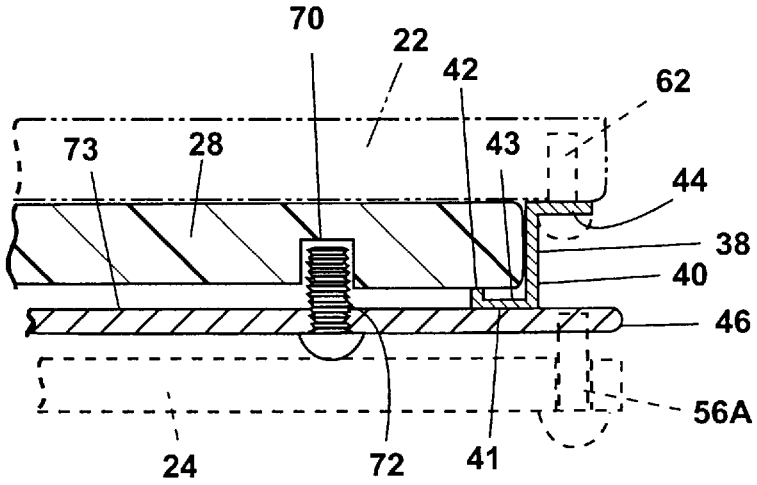
FIG. 4 is a cross sectional view of a portion of the mouse support assembly illustrating a slidestop taken along line 4—4 of FIG. 2.

As shown in FIGS. 3 and 4, a threaded fastener or stud 72 is received within a threaded aperture 74 in the mounting plate 46 and projects into an elongate groove 70 formed in the bottom of the central section 28 and mouse support trays 30, 32. The groove 70 extends entirely along the length of the central section 28 and partially into the right and left mouse support trays 30 and 32. The terminal ends of the groove 70 together with the stud 72 function as a stop when one of the support trays 30, 32 is completely exposed to prevent the sections from sliding completely off of the rails 38. Although the stud 72 is illustrated as threaded, it is to be understood that the stud can be non-threaded.

In a typical application, the keyboard support tray 22 is supported by the mounting bracket 24 and articulated arm 26. The mouse support assembly 20 is installed by separating the tray 22 from the mounting bracket 24. The rails 38 are pre-installed to the mounting plate 46 to define a rail mounting assembly that is then secured to the mounting bracket 24. The central section 28 and mouse support trays 30 and 32 are then positioned between the rails such that the lower surfaces of the central section and trays contact the upper surfaces of the slide flanges 42. The keyboard tray 22 is then positioned over the rail mounting assembly such that a longitudinal axis of the keyboard tray 22 is substantially parallel to the rod 35, and then fastened to the rail.

Figure 5:
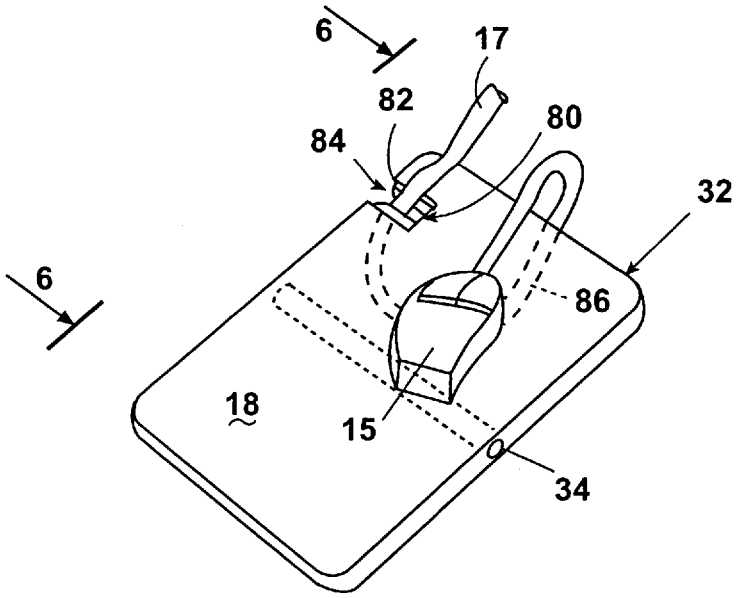
FIG. 5 is a perspective of an adjustable mouse support tray according to the invention.
Figure 6:
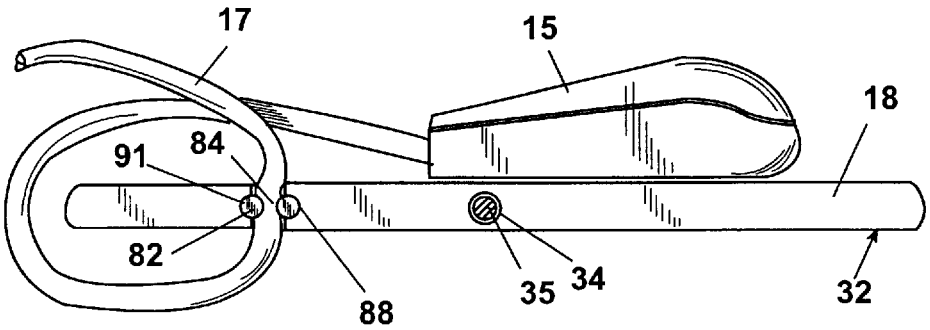
FIG. 6 is a elevational view of the adjustable mouse support tray taken along line 6—6 of FIG. 5.

With reference now to FIGS. 5 and 6, the left-handed mouse support tray 32 includes a slot 80 that extends preferably from an upper left edge of the tray and into the interior thereof. A resilient cord 82 formed of synthetic rubber or other flexible material is mounted to the inner opposing faces of the slot 80. As shown in FIG. 6, the inner faces 88, 91 of the slot 80 are curved inward to receive the resilient cords. The cords are preferably further secured to the slot 80 through adhesives or other well known securing means. A gap 84 between the cords 82 is in alignment with a longitudinal axis of the slot and is adapted to yieldably and frictionally engage the data cord 17 of the mouse 15. Prior to inserting the data cord 17 in the gap 84, a loop 86 is pre-formed in the cord to enable free movement of the mouse 15 on the upper surface 18 of the mouse support tray 32. The resilient material and slot are dimensioned so as to accommodate a variety of different data cord sizes. The yieldable nature of the resilient material prevents damage to the data cord while securely retaining the data cord in the slot. With this configuration, if the mouse 15 should inadvertently fall off the support tray, the resilient material will frictionally hold the cord 17 and prevent the mouse 15 from crashing to the floor, depending on the size of the loop 86. A similar arrangement for the right-handed mouse support tray 30 can be provided, with the slot 80 preferably extending from an upper right edge of the mouse support tray 30.

Figure 7:
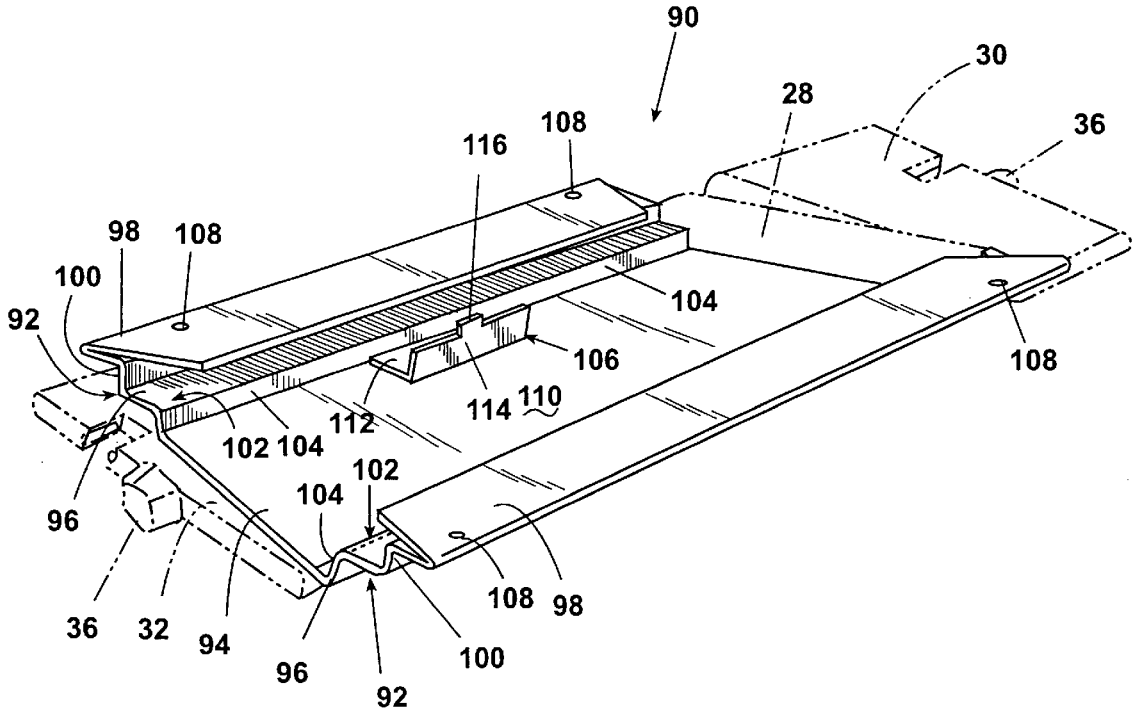
FIG. 7 is a perspective view of an adjustable mouse assembly according to a second embodiment of the invention.

With reference now to FIG. 7, a second preferred embodiment of a mouse support assembly 90 is illustrated, wherein like parts in the previous embodiment are represented by like numerals. The mouse support assembly 90 includes a pair of oppositely disposed rails 92 integrally formed with a mounting plate 94 by bending a single piece of sheet metal. The rails 92 each include a lower wall 96, an upper wall 98, and a side wall 100 connected between the lower and upper walls to form an inwardly facing open channel 102. The channels 102 slidably receive the right and left mouse support trays 30, 32, and the central section 28 (shown in phantom line). Each rail 92 is spaced from the mounting plate 94 by an integrally formed spacer section 104 that extends along the length of the rail. With this arrangement, the fasteners 56 (FIG. 3) can project upwardly from an upper surface 106 of the mounting plate 94 when the mouse support assembly 90 is mounted to the mounting bracket 24 (FIG. 3) without interfering with sliding movement of the mouse support trays 30, 32 and the central section 28. As in the previous embodiment, the mounting plate 94 may include one or more apertures (not shown) for receiving the fasteners 56. The upper walls 98 of the rails 92 preferably extend outwardly beyond their respective side wall 100 and include apertures 108 for fastening the mouse support assembly 90 to the keyboard support tray 22. An L-shaped slide stop 110 has a first leg 112 that is preferably welded to the upper surface 106 of the mounting plate 94 and a second leg 114 that projects upwardly from the upper surface 106. A distal end of the second leg 114 includes a tab 116 that projects into the elongate groove 70 (FIG. 3) formed in the bottom of the central section 28 and mouse support trays 30, 32. When assembled, the mouse support trays 30, 32 and the center section 28 are captured between the lower walls 96, the upper walls 98, and the side walls 100. The L-shaped slide stop 110 cooperates with the terminal ends of the elongate groove 70 to prevent the mouse support trays and center section from sliding completely out of the rails. This is especially advantageous during installation of the mouse support assembly and subsequent adjustment of the assembly to alternately expose the right or left mouse support trays.

Although the rails and mounting plate have been described as being bent formed from a single piece of sheet metal, they can alternatively be integrally formed as a single metallic or plastic extrusion and then cut to length. The slide stop 110 can then be attached to the plate 106 through welding, adhesives, vibration, or other well-known techniques.

Reasonable variation and modification are possible within the spirit of the foregoing specification and drawings without departing from the scope of the invention.

The embodiments of the invention in which an exclusive property or privilege is claimed are defined as follows:

1. An adjustable support assembly adapted for attachment to a computer keyboard support tray, the support assembly comprising:

a pair of spaced-apart rails adapted for mounting to the keyboard support tray;

an insert mounted for slidable movement on the rails, the insert having a first end and a second end;

a first support pad connected to the first end of the insert for movement therewith and a second support pad connected to the second end of the insert for movement therewith, each of the first and second support pads having an upper surface for supporting a digitizing device;

wherein the insert longitudinally spaces the first support pad from the second support pad; and wherein the insert can be positioned relative to the rails so that at least one of the first and second support pads is extended to an accessible position by a user for operation of the digitizer device on the upper surface thereof.

2. An adjustable support assembly according to claim 1 wherein at least one of the first and second support pads is pivotally attached to the insert for rotational movement about a pivot axis substantially parallel to the direction of slidable movement, to thereby adjust an angular position of said one support pad independent of the angular position of the keyboard support tray.

3. An adjustable support assembly according to claim 2 and further comprising a pivot rod connected to the insert and said one support pad and extending along the pivot axis to pivotally attach the at least one of the first and second support pads to the insert.

4. An adjustable support assembly according to claim 3 wherein the insert comprises a lower surface in sliding contact with the rails, opposite end surfaces projecting upwardly from the lower surface and an aperture extending between the opposite end surfaces; and further wherein said one support pad comprises an upper surface, opposite end surfaces projecting downwardly from the upper surface, and an aperture extending between the support pad opposite end surfaces; the pivot rod extending through each aperture for pivotally connecting the insert to the at least one of the first and second support pads.

5. An adjustable support assembly according to claim 4 and further comprising a fastener attached to the pivot rod for selectively clamping the insert and at least one of the first and second support pads together to thereby prevent relative rotation therebetween.

6. An adjustable support assembly according to claim 1 and further comprising a mounting plate secured to the rails, the mounting plate being adapted for connection to an articulating arm associated with the keyboard support tray.

7. An adjustable support assembly according to claim 6 wherein the mounting plate is integrally formed as a single piece with the rails.

8. An adjustable support assembly according to claim 1 wherein at least one of the first and second support pads comprises at least one outer edge and a slot extending inwardly from the outer edge, the slot being adapted to frictionally receive and hold a data cord of the digitizing device.

9. An adjustable support assembly according to claim 8 wherein the slot has a pair of inner opposing faces, and further comprising a piece of resilient friction material attached to each inner face, the pieces of resilient friction material projecting from the faces toward each other to create a gap therebetween for yieldably receiving and frictionally holding data cords of different cross dimensions.

10. An adjustable support assembly according to claim 1 wherein the upper surface of said one support pad is textured to thereby enhance digitizer tracking movement.

11. An adjustable support assembly adapted for attachment to a computer keyboard support tray, the support assembly comprising:

a pair of spaced-apart rails adapted for mounting to the keyboard support tray;

an insert mounted for slidable movement on the rails; and a support pad connected to the insert for slidable movement therewith between a retracted storage position wherein the support pad is in contact with the rails and an extended in-use position wherein the support pad is free of the rails, the support pad having an upper surface for supporting a digitizing device, wherein the support pad is pivotally attached to the insert for rotational movement about a pivot axis substantially parallel to the direction of slidable movement, to thereby adjust an angular position of the support pad independent of the angular position of the keyboard support tray;

a pivot rod connected to the insert and support pad and extending along the pivot axis to pivotally attach the support pad to the insert, wherein the insert comprises a lower surface in sliding contact with the rails, opposite end surfaces projecting upwardly from the lower surface and an aperture extending between the opposite end surfaces; and further wherein the support pad comprises an upper surface, opposite end surfaces projecting downwardly from the upper surface, and an aperture extending between the support pad opposite end surfaces; the pivot rod extending through each aperture for pivotally connecting the insert to the support pad; and a fastener attached to the pivot rod for selectively clamping the insert and support pad together to thereby prevent relative rotation between the insert and support pad.

12. An adjustable support assembly adapted for attachment to a computer keyboard support tray, the support assembly comprising:

a pair of spaced-apart rails adapted for mounting to the keyboard support tray;

an insert mounted for slidable movement on the rails;

a support pad connected to the insert for slidable movement therewith between a retracted storage position wherein the support pad is in contact with the rails and an extended in-use position wherein the support pad is free of the rails, the support pad having an upper surface for supporting a digitizing device; and a second support pad connected to the insert in a manner such that the insert is disposed between the first mentioned support pad and the second support pad, the second support pad being slidable with the insert between the retracted storage position wherein the second support pad is in contact with the rails and a second extended in-use position wherein the second support pad is free of the rails.

13. An adjustable support assembly according to claims 12 wherein each support pad is pivotally attached to the insert for rotational movement about a pivot axis substantially parallel to the direction of slidable movement, to thereby permit independent adjustment of an angular position of each support pad, when extended, irrespective of the angular position of the keyboard support tray.

14. An adjustable support assembly according to claim 13 and further comprising a pivot rod connected to the insert and each support pad and extending along the pivot axis to pivotally attach the support pads to the insert.

15. An adjustable support assembly according to claim 14 wherein the insert comprises a lower surface in contact with the rails, opposite end surfaces projecting upwardly from the lower surface and an aperture extending between the opposite end surfaces; and further wherein each support pad comprises an upper surface, an inner end surface facing the insert, an outer end surface facing away from the insert, the inner and outer surfaces projecting downwardly from the upper surface, and an aperture extending between the inner and outer end surfaces; the pivot rod extending through each aperture for pivotally connecting the insert to the support pads.

16. An adjustable support assembly according to claim 15 wherein the ends of the pivot rod extend outwardly from the outer end surfaces of the support pads, and further comprising an adjustable fastener attached to each end of the pivot rod for clamping the insert and support pads together to thereby prevent relative rotation between the insert and support pads.

17. An adjustable support assembly according to claim 15 and further comprising a mounting plate secured to the rails, the mounting plate being adapted for connection to an articulating arm associated with the keyboard support tray.

18. An adjustable support assembly according to claim 17 wherein the lower surface of the insert has a groove extending between the end surfaces of the insert, and wherein each of the support pads has a lower surface extending between the inner and outer end surfaces thereof, and a groove in each support pad lower surface beginning at the inner end surface and terminating before the outer end surface; and further comprising a stop member attached to the mounting plate and projecting into one of the grooves;

whereby sliding movement of the insert and support pads is halted when the stop member contacts one of the groove terminations.

19. An adjustable support assembly according to claim 12 wherein at least a substantial portion of the insert and support pads are sized to be received completely under the keyboard support tray when the support pads are in the retracted storage position.

20. The combination of a support tray having an upper surface for supporting a computer keyboard and a support pad having an upper surface for supporting a digitizer device, comprising:

a locking pivot joint for pivotally connecting and selectively locking the support pad to the support tray about a pivot axis that is parallel to a longitudinal axis of the support tray, to thereby adjust an angular position of the support pad with respect to horizontal, independent of the angular position of the support tray with respect to horizontal;

wherein the support pad is slidably mounted to the support tray between a retracted storage position under the support tray and an extended in-use position wherein the upper surface of the support pad is free of the support tray;

a pair of spaced-apart rails mounted to a lower surface of the keyboard support tray;

an insert mounted for slidable movement on the rails; the support pad being connected to the insert for slidable movement therewith between the retracted position wherein the support pad contacts the rails and the extended position wherein the support pad is free of the rails; and a second support pad connected to the insert in a manner such that the insert is disposed between the first-mentioned support pad and the second support pad, the second support pad being slidable with the insert between the retracted storage position wherein the second support pad is in contact with the rails, and a second extended in-use position wherein the second support pad is free of the rails and the first support pad is in contact with the rails.

21. The combination according to claim 20 wherein the insert is non-rotatable with respect to the support tray and each support pad is pivotally attached to the insert at the locking pivot joint, and wherein the pivot axis is substantially parallel to the direction of slidable movement, to thereby permit independent adjustment of an angular position of each support pad, when extended, irrespective of the angular position of the keyboard support tray.

22. The combination according to claim 21 wherein the locking pivot joint comprises a pivot rod connected to the insert and each support pad, the pivot rod extending along the pivot axis to pivotally attach the support pads to the insert.

23. The combination according to claim 22 wherein the insert comprises a lower surface in contact with the rails, opposite end surfaces projecting upwardly from the lower surface and an aperture extending between the opposite end surfaces; and further wherein each support pad comprises an upper surface, an inner end surface facing the insert, an outer end surface facing away from the insert, the inner and outer end surfaces projecting downwardly from the upper surface, and an aperture extending between the inner and outer end surfaces; the pivot rod extending through each aperture for pivotally connecting the insert to the support pads.

24. The combination according to claim 23 wherein the ends of the pivot rod extend outwardly from the outer end surfaces of the support pads, and wherein the locking pivot joint further comprises an adjustable fastener attached to each end of the pivot rod for clamping the insert and support pads together to prevent relative rotation between the insert and support pads.

25. The combination according to claim 23 sand further comprising a mounting plate secured to the rails for spacing the rails a predetermined distance apart.

26. The combination according to claims 25, and further in combination with an articulating arm having opposite ends, one end of the articulating arm being adapted for mounting to a support structure, and the other end of the articulating arm being connected to the mounting plate for adjustable positioning of the support tray and support pads with respect to the support structure.

27. The combination according to claim 25 wherein the lower surface of the insert has a groove extending between the end surfaces of the insert, and wherein each of the support pads has a lower surface extending between the inner and outer end surfaces, and a groove in the lower surface of each support pad beginning at the inner end surface and terminating before the outer end surface; and further comprising a stop member attached to the mounting plate and projecting into one of the grooves;

whereby sliding movement of the insert and support pads is halted when the stop member contacts one of the groove terminations.

28. The combination according to claims 20 wherein at least a substantial portion of the insert and support pads are sized to be received completely under the keyboard support tray when the support pads are in the retracted storage position.

29. An adjustable support assembly adapted for attachment to a computer keyboard support tray having a lower surface that includes a guide channel, the support assembly comprising:

first and second support pads adapted to be slidably received in the guide channel for movement in a longitudinal direction said first and second support pads being pivotally connected together by a joint such that said first support pad is rotatable about a pivot axis relative to said second support pad; and a generally longitudinally extending groove formed in a bottom portion of at least said second support pad for cooperating engagement with a stop member to limit movement of said first and second pads.

30. A combination support tray for a computer keyboard and a support pad for a digitizer device comprising:

a guide member located on a lower surface of said keyboard support tray for movably receiving said digitizer support pad for movement along a first directional axis;

a pivot joint for pivotally connecting said digitizer support pad to said keyboard support tray and permit said digitizer support pad to be pivotally adjusted relative to said keyboard support tray about a pivot axis that is parallel to said first directional axis; and a longitudinally extending groove formed in a bottom portion of said digitizer support pad for cooperating engagement with a stop member to limit further movement of said digitizer support pad relative to said keyboard support tray when said digitizer support pad is fully extended.

* * * * *